US006188304B1

(12) United States Patent
Skinner et al.

(10) Patent No.: US 6,188,304 B1
(45) Date of Patent: Feb. 13, 2001

(54) IGNITION COIL WITH MICROENCAPSULATED MAGNETS

(75) Inventors: Albert Anthony Skinner, Anderson; David Allen Score, Shirley, both of IN (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/519,042

(22) Filed: Mar. 3, 2000

(51) Int. Cl.[7] ..... H01F 27/04
(52) U.S. Cl. ..... 336/107; 336/110
(58) Field of Search ..... 336/90, 92, 96, 336/100, 110, 107, 192, 198; 123/634, 635

(56) References Cited

U.S. PATENT DOCUMENTS

| | | | | |
|---|---|---|---|---|
| 4,981,635 | * | 1/1991 | Yamashita et al. | 264/112 |
| 5,190,684 | * | 3/1993 | Yamashita et al. | 252/62.54 |
| 5,335,642 | | 8/1994 | Hancock et al. | 123/634 |
| 6,025,770 | * | 2/2000 | Okamoto et al. | 336/83 |
| 6,039,014 | * | 3/2000 | Hoppie | 123/90.11 |

FOREIGN PATENT DOCUMENTS 10-223464 * 8/1998 (JP) .

* cited by examiner

*Primary Examiner*—Lincoln Donovan
*Assistant Examiner*—Tuyen T. Nguyen
(74) *Attorney, Agent, or Firm*—Margaret A. Dobrowitsky

(57) ABSTRACT

An ignition coil for a spark ignition engine includes a cylindrical magnetic core having opposite first and second ends. Preferably, the magnetic core has a circular cross section. Permanent magnets similarly shaped as the core are disposed at the ends of the magnetic core. The magnets are made from a microencapsulated magnetic material, resulting in increased resisitivity and decreased eddy current loss. By using the microencapsulated magnets, the voltage output of the ignition coil is increased while requiring no additional input energy. A primary winding is wound about the magnetic core between the first and second ends. A secondary winding assembly is disposed about the primary winding and the core. The secondary winding assembly includes a spool and secondary winding wound thereon. The secondary winding is inductively coupled to the primary winding. An outer case is disposed about said magnetic core, magnets and the primary and secondary windings.

5 Claims, 1 Drawing Sheet

IGNITION COIL WITH MICROENCAPSULATED MAGNETS

TECHNICAL FIELD

This invention relates to an ignition coil for a spark ignition engine, and more particularly to an ignition coil having microencapsulated magnets to reduce eddy current losses.

BACKGROUND OF THE INVENTION

It is well known in the art of ignition systems for automotive vehicles to have an ignition coil that produces magnetic energy upon discharge to create a high voltage spark to initiate combustion in an engine cylinder. Permanents magnets may be used to bias the core in the ignition coil to permit an increase in the stored magnetic energy in a magnetic circuit of the ignition coil.

Typically, an ignition coil includes primary and secondary windings each wound around a spool and disposed about a cylindrical magnetic core with the primary winding surrounding the secondary winding. Cylinder shaped permanent magnets are disposed at the ends of the magnetic core. To make this type of ignition coil compact, the magnetic core is made smaller than in other types of ignition coils. However, one drawback with this type of ignition coil is that, due to the levels of bias required with the small cores, the magnets have to have a very high energy product. This requirement limits the useable material for the magnets to materials like sintered neodymium-iron-boron (NdFeB) and samarium-cobalt (SmCo). The sintered magnets have a very low resisitivity, $2\times10^{-4}$ ohm-cm, which yields high eddy current losses in the magnets. Usually, the diameter of the magnets is the same as the diameter of the magnetic core and they are typically 4 to 5 mm long. This creates a large eddy current path around the diameter of the magnets, resulting in an eddy current loss that is proportional to the diameter squared. In some coil designs, 15 to 20% of the energy lost is due to the eddy current losses in the magnets. There is a need to reduce the magnet eddy current losses to improve the efficiency of the ignition coil.

SUMMARY OF THE INVENTION

The present invention provides an ignition coil for a spark ignition engine having microencapsulated permanent magnets to reduce eddy current losses. The coil includes a magnetic core having opposite first and second ends. The magnetic core is a cylindrical member preferably having a circular cross section. At least one magnet is disposed at one of the ends of the magnetic core. Magnets are preferably disposed at both ends of the core. A primary winding is wound about the magnetic core between the first and second ends. A secondary winding assembly is disposed about the primary winding and the core. The assembly includes a spool and secondary winding wound thereon. The secondary winding is inductively coupled to the primary winding. An outer case is disposed about said magnetic core, magnets and the primary and secondary windings.

The present invention provides an efficient ignition coil by reducing the eddy current losses of the permanent magnets. The eddy current losses are reduced by making the permanent magnets from microencapsulated magnetic material. The magnets are made of a powder of rare earth, high energy materials such as neodymium and samarium dispersed within a binder, such as a plastic or epoxy. In one embodiment the powder is made from NdFeB and is compacted to yield a high density. The microencapsulated magnets provide a magnetic core biasing that is less than the biasing obtained with a sintered NdFeB or SmCo magnet. However, the decrease in energy is made up by the fact that the eddy current losses are negligible due to the increased resisitivity of the material. The resisitivity of the material is from $2\times10^{-3}$ to $1\times10^{-1}$ ohm-cm, resulting in kilovolt performance that is approximately identical to the other type of ignition coil. The lower core biasing can also be offset by the use of a larger magnetic core.

The present invention also provides an ignition coil with increased voltage at a given charge time and primary current over an ignition coil having sintered NdFeB and SmCo magnets. When using microencapsulated magnets, less energy has to be stored for the same voltage, which allows the charge time and primary current to be limited, resulting in an ignition coil that offers superior performance.

These and other features and advantages of the invention will be more fully understood from the following description of certain specific embodiments of the invention taken together with the accompanying drawings.

DESCRIPTION OF THE PREFERRED EMBODIMENT

Figures 1, 2:
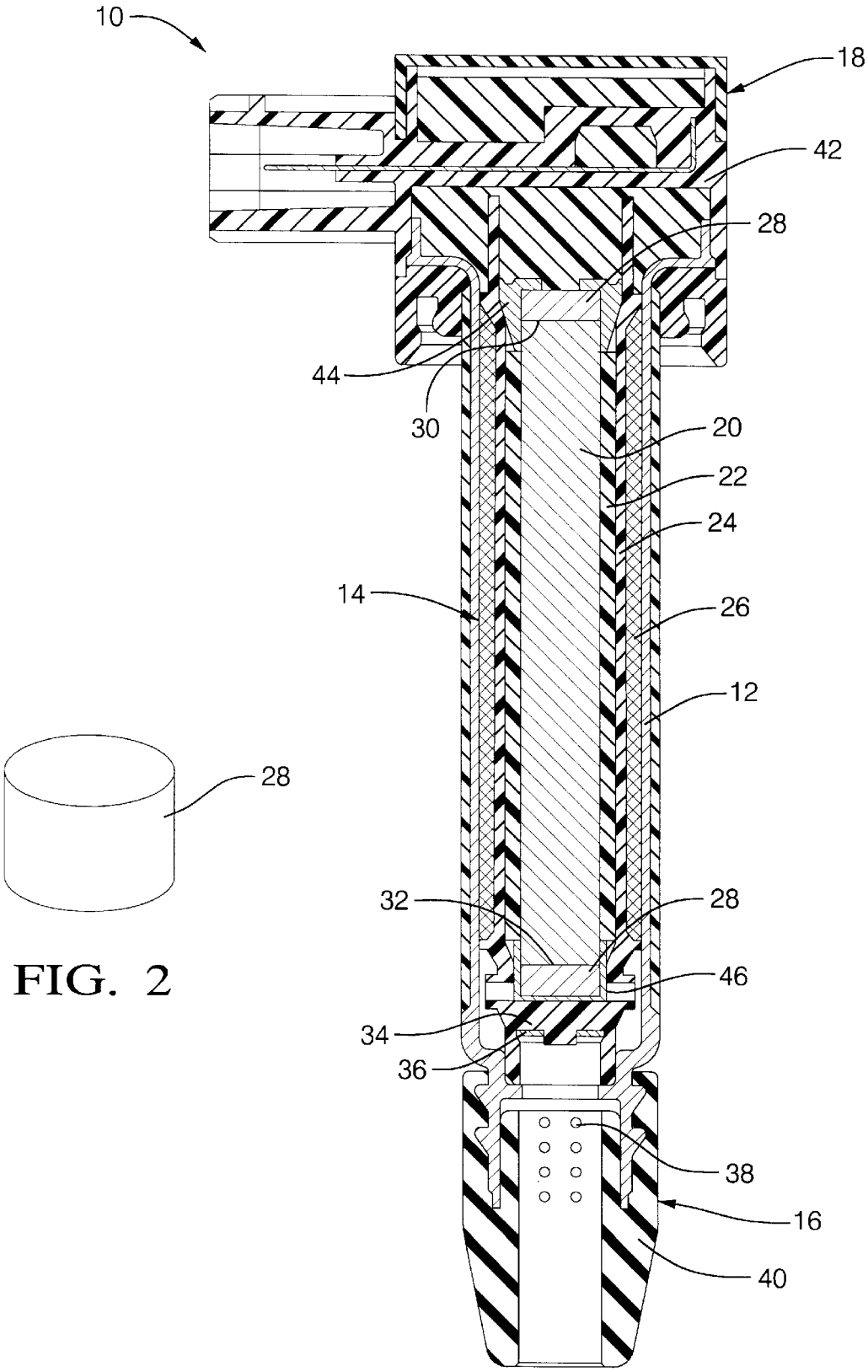
FIG. 1 is a cross-sectional view of an ignition coil including microencapsulated magnets in accordance with the present invention.
FIG. 2 is a perspective view of a microencapsulated magnet used in the ignition coil of the present invention.

Referring now to FIG. 1 of the drawings in detail, numeral 10 generally indicates an ignition coil for an automotive vehicle. The ignition coil 10 is to be employed in an ignition system of an internal combustion engine to produce high voltage charges to spark plugs sufficient to result in a desired electric arc to initiate combustion within an engine cylinder. Ignition systems may employ a single ignition coil with mechanical or electronic distribution of the high voltage sequentially to multiple spark plugs in a multi-cylinder engine. Alternatively, the ignition system may employ a so-called pencil coil associated with each cylinder of a multi-cylinder internal combustion engine. The ignition coil 10 is a pencil coil for a system having a oil for each spark plug.

The ignition coil 10 includes a rigid insulating outer case 12 enclosing a transformer assembly 14 connected at one end with a spark plug assembly 16 for supplying voltage to a spark plug (not shown). At another end, transformer assembly 14 connects with a connector assembly 18 for external electrical interface with circuitry that controls the current to the coil 10.

The transformer assembly 14 includes, coaxially arranged from the inside out, a magnetic core 20, a primary winding 22, a secondary spool 24 and a secondary winding 26. Cylindrical permanent magnets 28 are disposed on opposite ends 30,32 of the magnetic core 20. The magnetic core 20 is a cylindrical member having a circular cross section. Core 20 may be formed of composite iron powder particles and electrical insulating material, which are compacted or molded into the cylindrical member. The particles of iron powder are coated with the insulating material. The insulating material forms gaps, like air gaps, between the particles and also serves to bind the particles together. The final molded part may be, by weight, about 99% iron particles and 1% plastic material. By volume, the part may be about 96% iron particles and 4% plastic material. After the core 20 is molded, it is machine finished such as by grinding, to provide a smooth surface for direct winding of the primary winding 22 thereon. A coating of insulating material may be applied to the outside surface of the magnetic core to insulate it from the primary winding.

Alternatively, the magnetic core 20 may be comprised of longitudinally extending laminated silicon steel strips. The strips may have a fixed length and a variety of widths to form a cylindrical member.

The primary winding 22 is wound directly on the insulated surface of the magnetic core 20. The primary winding 22 may be comprised of two winding layers, each being comprised of 106 turns of No. 23 AWG wire. Application of the primary winding 22 directly upon the core 20 provides for efficient heat transfer of the primary resistive losses and improved magnetic coupling which is known to vary substantially inversely proportionally with the volume between the primary winding 22 and the core 20. This type of construction also allows for a more compact coil assembly.

The secondary winding 26 is wound around the secondary spool 24. The secondary winding 26 may be comprised of 9010 total turns of No. 43 AWG wire. The secondary spool 24 has a bottom 34 on which a terminal plate 36 is fixed. The terminal plate 36 is connected to the secondary winding 26 through a lead wire (not shown) and the terminal plate 36 is connected to a spring clip 38 of the spark plug assembly 16. The spark plug assembly 16 includes a boot 40 enclosing the spark plug and the spring clip 38, which connects the spark plug to the secondary winding 26.

The connector assembly 18 includes a connector body 42 that is molded to enclose primary terminals (not shown). The primary terminals are connected with the primary winding 22 to connect the primary winding 22 to external circuitry to control the current flow to the primary winding 22.

The permanent magnets 28 are disposed on the opposite ends 30,32 of the magnetic core 20 so that their magnetic fluxes are oriented opposite the magnetic flux generated by the primary winding 22. As shown in FIG. 2, the permanent magnets 28 are generally cylindrical and have the same diameter as the magnetic core 20. Magnet 28 at end 30 is disposed within a cap 44 which is attached to the magnetic core 20. The other magnet 28 at end 32 is disposed within a cup 46.

The permanent magnets 28 allow the storage of additional magnetic energy to the coil 10. Prior to the energization of the primary winding 22, the magnetic core 20 is magnetized by the magnetizing forces of the permanent magnets 28 to reach a state of maximum working magnetic flux density in the negative direction which is opposite to the direction of magnetization to be caused by the energization of the primary winding 22. Then, when a primary current is fed to the primary winding 22, a magnetizing force is generated opposite to the magnetizing force of the permanent magnets 28. This causes the core 20 to be magnetized to reach a state of maximum working magnetic flux density in the positive direction. In this state, when the primary current is interrupted at a point of ignition timing, the secondary winding 26 can utilize an effective interlinkage flux which may be twice as great as the effective interlinkage flux obtained in a conventional ignition coil which uses no permanent magnet but only the energization of the primary winding so as to magnetize the magnetic core to reach a state of a maximum working magnetic flux density in the positive direction.

Typically, an ignition coil has a magnetic core and disposed about it a secondary winding wound on a spool and a primary winding wound on a spool disposed about the secondary winding. To make the ignition coil compact, the magnetic core is made smaller than in other constructions. To compensate for the loss in magnetic energy due to the smaller magnetic core, sintered permanent magnets such as NdFeB and SmCo are used.

In the present invention the primary winding 22 is wound around the magnetic core 20 and is disposed internally of the secondary winding 24 allowing a larger core to be used while keeping the construction of the ignition coil compact. With a larger magnetic core, a permanent magnet with a weaker energy product may be used, such as a microencapsulated magnet. The magnets are made of a NdFeB powder dispersed within a binder such as plastic or epoxy and compacted to yield a high density. The magnets may be made by such known methods as dynamic magnetic compaction (DMC), isostatic presses and standard mechanical compaction presses.

The microencapsulated magnets have a smaller density than the sintered magnets and thus they produce less magnetic energy than the sintered magnets. The decrease in energy can be made up by the fact the microencapsulated magnets have a greater resisitivity than sintered magnets. The resisitivity of microencapsulated permanent magnets may range from $2\times10^{-3}$ to $1\times10^{-1}$ ohm-cm and the resisitivity of sintered magnets is $2\times10^{-4}$ ohm-cm. By having a higher resisitivity, the eddy current losses of the microencapsulated magnets are less than the eddy current losses of the sintered magnets. Thus, the ignition coil with the microencapsulated magnets can provide a kilovolt performance that is approximately equal to the coil with sintered magnets but less energy is stored which allows the charge time and primary current to be specified for various applications. Further, the ignition coil of the present invention provides an equally effective coil at a lower cost than the ignition coil with sintered magnets.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An ignition coil for a spark ignition engine comprising:

a cylindrical magnetic core having opposite first and second ends;

at least one permanent magnet disposed at one of said ends of the magnetic core, said at least one permanent magnet made from a microencapsulated magnetic material;

a primary winding wound about said magnetic core between the first and second ends;

a secondary winding assembly including a spool and a secondary winding wound thereon, said secondary winding being inductively coupled to the primary winding; and an outer case disposed about said magnetic core, magnet and the primary and secondary windings.

2. An ignition coil of claim 1 wherein the magnetic core is insulated and the primary winding is wound directly on the magnetic core.

3. An ignition coil of claim 1 wherein a magnet is disposed at each of said ends of the magnetic core.

4. An ignition coil of claim 1 wherein the microencapsulated magnetic material is an NdFeB powder dispersed within an epoxy.

5. An ignition coil of claim 1 wherein the magnets have a resisitivity from $2\times10^{-3}$ to $1\times10^{-}$ohm-cm.

* * * * *